United States Patent [19]

Cavier et al.

[11] 4,177,703

[45] Dec. 11, 1979

[54] SLICING MACHINE FOR SALMON

[76] Inventors: Adolf J. J. F. Cavier, Flerrentwiete 49a, 2000 Hamburg 56; Rudolf Maass, Bahrenfelder Chaussee 73, 2000 Hamburg 50, both of Fed. Rep. of Germany

[21] Appl. No.: 897,749

[22] Filed: Apr. 17, 1978

[51] Int. Cl.[2] ..... B26D 4/38

[52] U.S. Cl. ..... 83/356.3; 83/444; 83/490; 83/647.5

[58] Field of Search ..... 83/356.3, 355, 490, 83/647.5, 444, 409.2, 411 A

[56] References Cited

U.S. PATENT DOCUMENTS

| | | | |
|---|---|---|---|
| 1,912,365 | 6/1933 | Folk | 83/490 X |
| 1,942,563 | 1/1934 | Mood | 83/490 X |
| 2,391,719 | 12/1945 | Llewellyn | 83/356.3 |
| 3,515,190 | 6/1970 | Moriuchi | 83/490 X |
| 3,530,915 | 9/1970 | Moriuchi | 83/647.5 X |
| 3,808,782 | 5/1974 | McWilliams | 83/444 X |
| 3,842,698 | 10/1974 | Fitch et al. | 83/490 X |
| 3,867,858 | 2/1975 | Tsuchiya et al. | 83/409.2 X |
| 3,985,057 | 10/1976 | Bettcher | 83/409.2 X |

FOREIGN PATENT DOCUMENTS

| | | |
|---|---|---|
| 694115 | 6/1940 | Fed. Rep. of Germany . |
| 470944 | 5/1969 | Switzerland . |

*Primary Examiner*—Frank T. Yost

*Attorney, Agent, or Firm*—Stevens, Davis, Miller & Mosher

[57] ABSTRACT

A salmon slicing machine comprising a frame, a stationary sun gear and a rotatable shaft mounted on said frame, a stop plate and circular supporting parts having circular grooves mounted for rotation on said rotatable shaft, circular knives positioned under said circular supporting parts and mounted for horizontally rotating and orbiting around said stationary sun gear, a hydraulic piston to adjust said stop plate relative to said circular knives and a feeding mechanism for the material to be sliced inclined at an acute angle to the plane of rotation of the knives.

5 Claims, 4 Drawing Figures

Fig.3
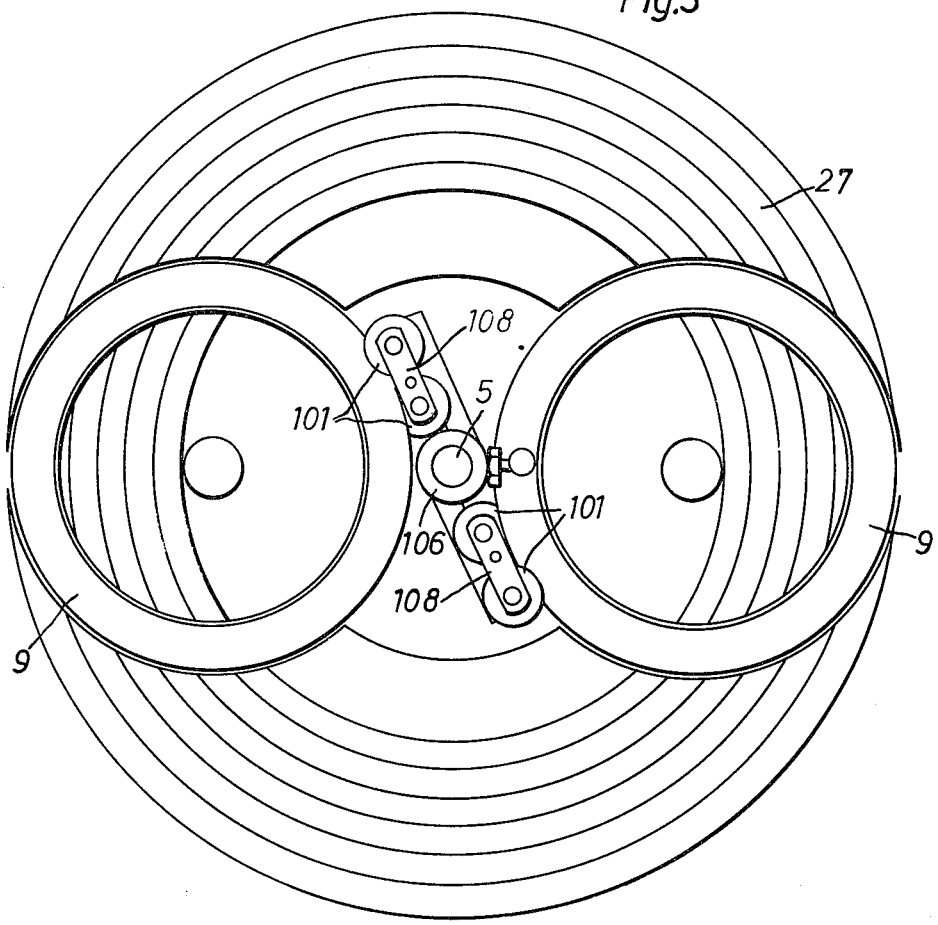
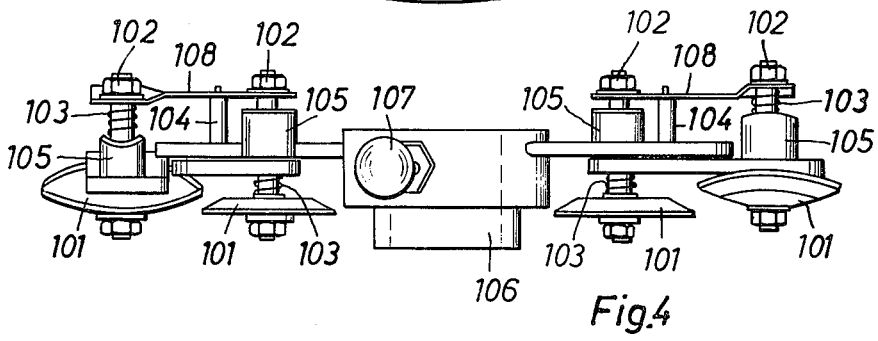
Fig.4

SLICING MACHINE FOR SALMON

The present invention relates to a slicing machine having rotating circular knives which move in planet-like fashion. It serves in particular for producing cold cuts or cutting salmon into slices in the fish industry.

Various devices are already known by which it has been attempted to carry out this process automatically. Thus, for instance in accordance with West German Utility Model No. 1,831,114 there is known a slicing machine which has a set of rotating circular knives which move in planet-like fashion in a vertical plane. The machine has magazines for receiving the material to be cut the latter being pressed at right angles against the cutting edge of the circular knives. An oblique cut—as is particularly desirable in the case of sliced salmon—over the side of the salmon however is not possible with the apparatus. In addition, the cleaning and grinding of the knives requires a considerable amount of mounting work, which leads to a corresponding loss of time.

It has also been attempted in accordance with German unexamined application for patent No. 1 632 120 to move a rotating circular knife repeatedly in a swinging motion along a magazine for the material to be cut, the material in this case also being applied at a right angle to the cutting plane of the knife. Accordingly, in this case also an oblique cut is not possible.

The object of the invention is to develop a slicing machine of the aforementioned type in such a manner that easy oblique cutting is possible, particularly the oblique cutting of sides of salmon. The salmon is in particular to be cut carefully and in uniform thickness. Furthermore, regrinding of the circuit knives, as required to assure a dependable slicing, must be capable of being effected in a simple manner.

Upon the cutting of salmon, a number of special features and problems arise which are not present upon the cutting of sausage or other foodstuffs.

Salmon in itself is not firm but it is nevertheless to be cut into uniform slices which are as thin as possible.

A solution for the slicing of salmon is proposed in accordance with the present invention by the provision of a cutting device having rotating circular knives moving in planet-like fashion around a stationary sun wheel and of stops which rotate simultaneously with the knives and are adjustable relative to the cutting plane thereof, the slicing machine being characterized by supporting parts which are present within the knives. A slicing machine for salmon in accordance with the invention has rotating circular knives traveling in planet-like fashion around a stationary sun wheel, stop plates which rotate simultaneously with the circular knives and are adjustable relative to the cutting plane thereof being furthermore provided, and it is characterized furthermore by the provision of a circular supporting part which covers the surface of the rotating circular knives and is provided with flanges, which supporting part rotates together with the stop plates in a horizontally unchangeable position. By these supporting parts a firm resting surface for the salmon is provided directly behind the cutting edge so that the cut slice is of entirely uniform thickness. Furthermore, the supporting parts can prevent the salmon from twisting due to the rotation of the knives.

In accordance with the invention, each of the rotating knives moves together with a separate stop plate while a feed guide for the material to be cut is provided which is inclined at an acute angle to the plane of rotation of the knives. In accordance with a preferred embodiment of the invention, the sun wheel of the planetary gearing is rigidly connected to the frame. The carrier for the knives preferably has boreholes which are traversed by pins fastened to the driving member. The feed for the material to be cut can be fastened rigidly to the cover, which is pivotally connected by a hinge to the frame of the machine. The angle between the feed device and the cutting plane of the knives is preferably 18° to 20°. The stop plates are vertically adjustable in order to be able to adjust the thickness of the slice while the stop plates as well as the circular knife guard plates which are supported within the knives or the supporting parts are preferably provided with rotating flanges.

One preferred embodiment of the invention will be described in further detail below with reference to the accompanying drawings, in which:

FIG. 3 is a top view of the slicing machine of the present invention on which the knife grinding device has been applied.

FIG. 4 shows a side view of the knife grinding device shown on a substantially larger scale than in FIG. 3.

Figure 1:
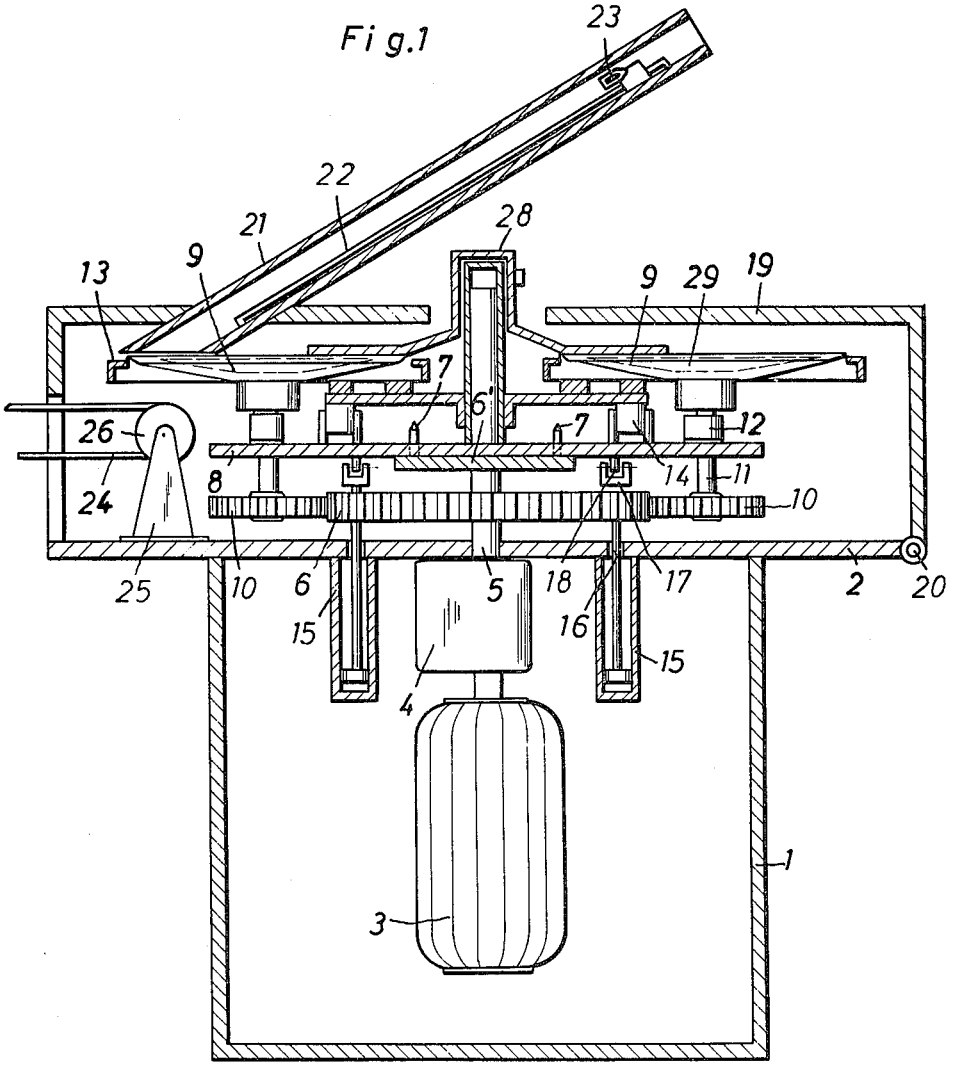
FIG. 1 is a vertical section through the slicing machine of the invention.
Figure 2:
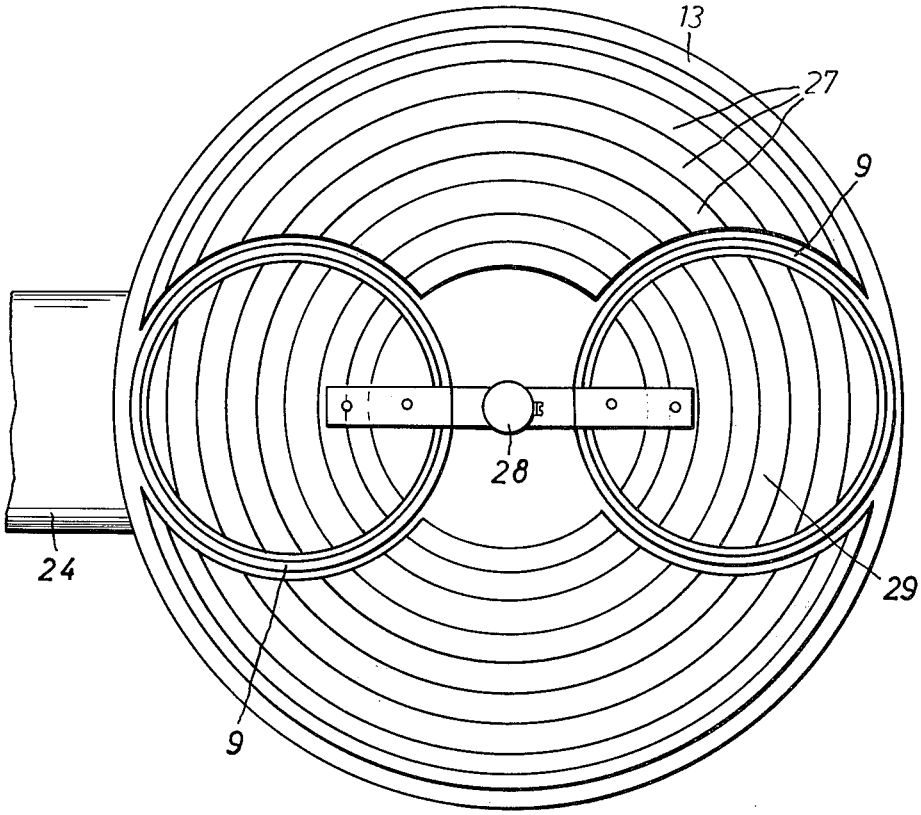
FIG. 2 is a top view of the machine with its cover removed.

On the frame 1 of the machine there is fastened a supporting plate 2 which bears the drive motor 3 for the slicing machine together with a transmission 4. The drive shaft 5 for the transmission passes through the sun wheel 6 of the planetary gearing which is rigidly connected to the supporting plate 2. To the drive shaft 5 there is connected a driver 6' which bears four upwardly directed drive pins or projections 7. The pins 7 pass through boreholes within a carrier 8 for the knives 9.

The knife carrier 8 forms the strap of the planetary gearing which consists of the aforementioned sun wheel 6 as well as the orbiting planet wheels 10. The shafts 11 of the planet wheels 10 are supported by the knife carrier 8. For this purpose there are used ball bearings 12 which are held by the knife carrier 8.

At the upper end of the shafts 11 the knives 9 are fastened. In the preferred embodiment of the invention only two knives are provided but four or more circular knives can be held by the knife carrier. Within the knives 9 there is a circular supporting part 29 provided with grooves, which is removable, for the cleaning of the machine, by means of a holding stop 28 supported on the central shaft.

The supporting part 29 is in its turn supported with respect to the rotating knife by a ball bearing or the like. The supporting part is furthermore due to its connection with the stop 28 arranged fixed relative to the grooves 27 of stop plate 13.

Directly below the cutting plane of the circular knives 9 is a cutting edge of stop plate 13 which is adjustable in height by the slice thickness adjustment 14. The slice thickness adjustment 14 rests on the knife carrier 8.

Below the supporting plate 2 there are fastened hydraulic cylinders 15 which are connected to a controllable pressure medium not shown in detail. The piston rods 16 which are actuated by the hydraulic device pass through the sun wheel 6 and at their upper end bear fork-shaped supports 17 to receive supporting rollers 18. A knife carrier 8 rests on the supporting rollers 18.

The slicing machine is closed off on top by a cover 19. The cover 19 is connected by a hinge 20 with the supporting plate 2. After the swinging up of the cover 19 the knives as well as the gearing are exposed.

Within the cover 19 there is provided a feed 21 for the material to be sliced, which feed forms an acute angle with the cutting plane of preferably between 15° and 35° and discharges in the region of the periphery of the knives 9. Within the feed 21 there is provided a guide 22 for a clamp 23 which holds the material to be sliced and possibly feeds it under hydraulic pressure to the cutting edge of the knife.

Below the feed 21 for the material to be sliced there is a conveyor belt 24 for the removal of the cut slices. The supporting pedestal 25 for the guide roller 26 of the conveyor belt 24 is fastened on the supporting plate 2.

Upon the operation of the slicing machine the drive shaft 5 is placed in rotation by the motor 3 which is provided with the transmission 4 in order to reduce its speed of rotation. The drive shaft 5 turns the driver 6 which via the pins 7 makes a force-locked connection with the knife carrier 8. The knife carrier 8 acts as strap of the planet gearing and places the planet wheels 10 together with the shafts 11 and the circular knives 9 in rotation around the sun wheel 6. In this way rotation of the circular knives themselves is effected.

The adjustment of the thickness of slice is effected by raising or lowering the cutting edge together with the stop plates. In order to reduce the friction between the material to be sliced and the stop plates as well as the knife guard plates, the latter are provided with rotating flanges 27. The material to be sliced is fed continuously via the feed 21 to the knife 9 whereupon, after the cutting of the slices the slices are deposited on the conveyor belt 24 which is also continuously moving. The conveyor belt 24 moves with a relatively low speed so that the slices are deposited in the form of the so-called serving cut onto the belt.

Due to the horizontal arrangement of the knives and the conveyor belt which is directly below them the slices are deposited with the correct side up, contrary to what is true in all other machines. Particularly in the case of salmon it is of importance that the sliced salmon which has again been assembled still look like a single piece.

For the cleaning of the machine and the regrinding of the knives the cover 2 is swung up around the hinge 20. The pressure medium is then fed to the hydraulic cylinders 12 through a valve (not shown), as a result of which the piston rods 16 are moved in upward direction. The supporting wheels 18 which hold the knife carrier 8 move the latter upward together with the knives 9. The pins fastened to the driver 6 upon this movement leave the boreholes contained in the knife carrier 8, so that the drive for the knives disengages. In this way safety upon the cleaning or regrinding of the knives is considerably increased in the event that by error the switch for the motor should be turned on. The machine is placed back in operation in the same simple fashion. By switching the control valve the pressure medium is discharged from the hydraulic cylinders 15 whereby the piston rods 16 are lowered together with the knife carrier 8 and the knives 9. In this way the pins 7 of the driver 6 come into engagement with the boreholes of the knife carrier 8. After the swinging closed of the cover 19 the machine is again ready for operation.

A knife grinding device has been shown in FIGS. 3 and 4. It consists of a central support 106 which can be fastened to the shaft 5. This is effected by a locking screw 107. On two sides of the central support 106, 180° apart, there are supports for, in each case, two wheel arbor supports 105. Each wheel arbor support 105 is fastened to the one side to a rocker lever 108 by means of a wheel arbor 102 and at its opposite end bears grinding wheels of conical shape. Between the supporting arms and the grinding wheels and between the wheel-arbor support 105 and the rocker lever 108 there are compression springs 103.

In order to grind the knives 9, the cover 19 of the slicing machine is first of all swung open and the holding stop 28, together with the supporting parts 29 fastened to it is removed. Thereupon the central support 106 is placed on the shaft 5 in such a position of rotation that the grinding wheels 101 are not in contact with the knives 9. The central support 106 is then swung so that in each case one grinding wheel 101 comes to lie above the knife while the other corresponding grinding wheel 101 comes to lie below the knife. In this position the central support 106 is fastened to the shaft 5 by tightening the locking screw 107. The motor of the slicing machine is then turned on. During the rotation of the motor the knives 9 are sharpened between the conical grinding wheels 101. After the completion of the sharpening or grinding process, the knife grinding device can be removed in any manner from the slicing machine.

We claim:

1. A salmon slicing machine comprising a frame, a stationary sun gear and a rotatable shaft mounted on said frame, a stop plate and circular supporting parts having circular grooves mounted for rotation on said rotatable shaft, circular knives positioned under said circular supporting parts and mounted for horizontally rotating and orbiting around said stationary sun gear, means to adjust said stop plate relative to said circular knives and a feeding means for the material to be sliced inclined at an acute angle to the plane of rotation of the knives.

2. The slicing machine according to claim 1, including a cover hinged on said frame and wherein the feed means for the material to be sliced is fastened rigidly to said cover and adjustable at an angle to said cover.

3. The slicing machine according to one of claims 1 and 2 wherein said stop plate is vertically adjustable in order to adjust the thickness of the slice.

4. The slicing machine according to claim 3 wherein said stop plate together with said circular supporting parts are provided with circular grooves.

5. The slicing machine according to claim 3, including a holding stop which interconnects said supporting parts within the knives and is supported on said rotatable shaft.

* * * * *